US006640367B2

(12) United States Patent
Hsia

(10) Patent No.: US 6,640,367 B2
(45) Date of Patent: Nov. 4, 2003

(54) PILLOWS

(76) Inventor: Chih-Yu Hsia, 301 Warren Way, Arcadia, CA (US) 91007

( * ) Notice: Subject to any disclaimer, the term of this patent is extended or adjusted under 35 U.S.C. 154(b) by 0 days.

(21) Appl. No.: 10/053,090

(22) Filed: Jan. 23, 2002

(65) Prior Publication Data

US 2003/0135927 A1 Jul. 24, 2003

(51) Int. Cl.[7] ..... A47G 9/00
(52) U.S. Cl. ..... 5/640; 5/636; 5/644
(58) Field of Search ..... 5/640, 636, 643, 5/644, 654, 655.3, 490

(56) References Cited

U.S. PATENT DOCUMENTS 1,343,357 A * 6/1920 Eggers ..... 5/654
3,008,153 A * 11/1961 Coulter ..... 5/654
4,588,229 A * 5/1986 Jay ..... 297/452.25
4,617,691 A * 10/1986 Monti et al. ..... 5/640
4,643,481 A * 2/1987 Saloff et al. ..... 297/452.25
4,726,624 A * 2/1988 Jay ..... 297/452.25
4,750,224 A * 6/1988 Stracke ..... 5/655.3
5,313,678 A * 5/1994 Redewill ..... 5/639
5,378,045 A * 1/1995 Siekman et al. ..... 297/452.25
5,390,384 A * 2/1995 Dinsmoor, III et al. ..... 5/654
5,395,162 A * 3/1995 Jay et al. ..... 297/452.25
5,513,899 A * 5/1996 Michaels et al. ..... 5/654 X
5,671,977 A * 9/1997 Jay et al. ..... 297/452.24
5,836,654 A * 11/1998 DeBellis et al. ..... 297/452.41
5,857,749 A * 1/1999 DeBellis et al. ..... 297/452.41
5,974,607 A * 11/1999 Smith ..... 5/636
6,047,425 A * 4/2000 Khazaal ..... 5/644
6,098,220 A * 8/2000 Momma ..... 5/636

* cited by examiner

*Primary Examiner*—Robert G. Santos

(57) ABSTRACT

An improved pillow consisting of a curved plate, a cushion having a thin middle portion and thick end portions and which may optionally consists of at least one inflatable air bag, and a fabric which encloses the cushion and the curved plate; the curved plate optionally consisting of at least two curved segment plates linked together by at least another curved plate; an improved pillow having an upper surface which has a valley in the center and a peak at each end.

3 Claims, 7 Drawing Sheets

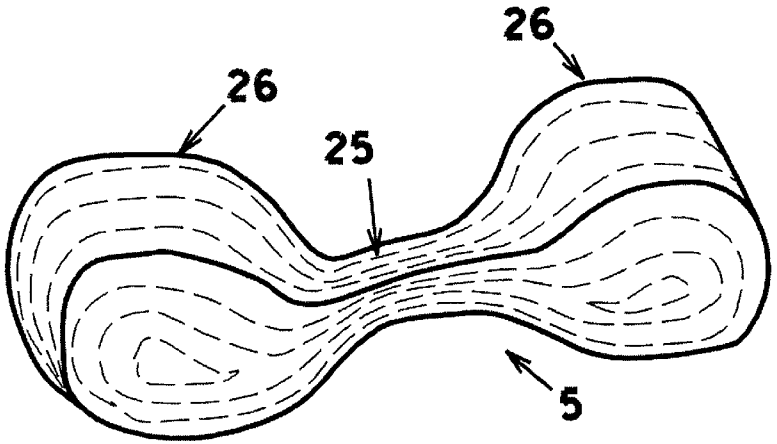
Fig. 5
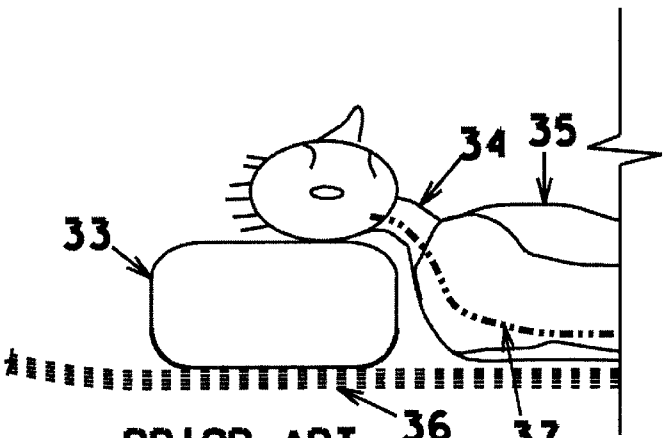
PRIOR ART Fig. 7
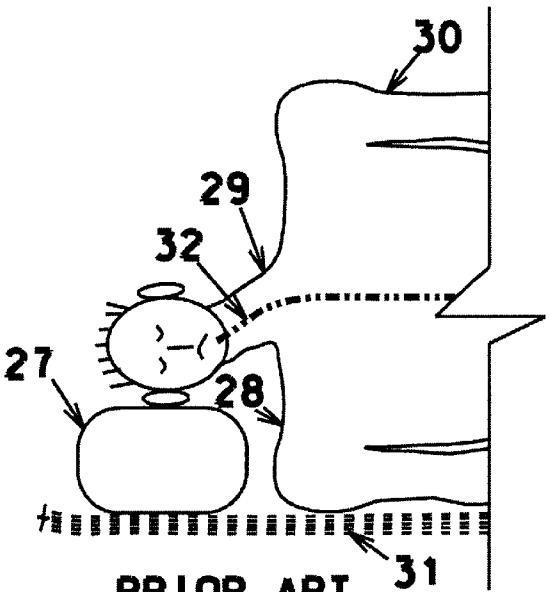
PRIOR ART Fig. 6

PILLOWS

BACKGROUND OF THE INVENTION

1. Field of the Invention

This invention relates to improvements on pillows such that an improved pillow allows the neck (the vertebrae cervicales) of a person who is lying on a bed to be in a natural comfortable position. One variation of the improved pillow not only allows a user's neck to be in a natural comfortable position but also allows the user to reposition his/her head on the pillow easily. The other variation of an improved pillow allows a user to easily adjust its heights.

2. Descriptions of the Prior Arts

No prior art related to the improved pillows was found.

SUMMARY OF THE INVENTION

Generally speaking, an ordinary pillow has uniform thickness. When an ordinary pillow is too thin (too low) comparing to half of the width of a sleeper's shoulder, the neck of the sleeper lying sideways bends downwards. In order to keep a side-lying sleeper's neck straight, a thick (high) pillow must be used. But, when the pillow is too thick (too high), the neck of the face-up sleeper bends forwards. The bent neck may pinch the nerves that come out from the Foramen inter-vertebrates. The pinches may hamper the relaxation or the rests of the nerves and may eventually cause pains to any over-used upper limbs. Therefore, a pillow that allows a sleeper to keep a straight neck is needed.

One of the objectives of the current invention is to improve a pillow such that it will provide supports to the head of a sleeper and to keep the neck of the sleeper in a straight relaxed position at all time. The other objective of the current invention is to device an improved pillow so that it can allow a sleeper to flip his/her facing direction easily. Another objective of the invention is to provide means to adjust the heights of a pillow easily.

These and other objects and advantages of the invention, as well as the details of an illustrative embodiment, will be more fully understood from the following specification and drawings, in which:

DRAWING DESCRIPTION

FIG. 5 is an isometric view of the third variation of an invented improved pillow.

FIG. 6 and FIG. 7 illustrate the disadvantages of using the ordinary pillows.

Figure 8:
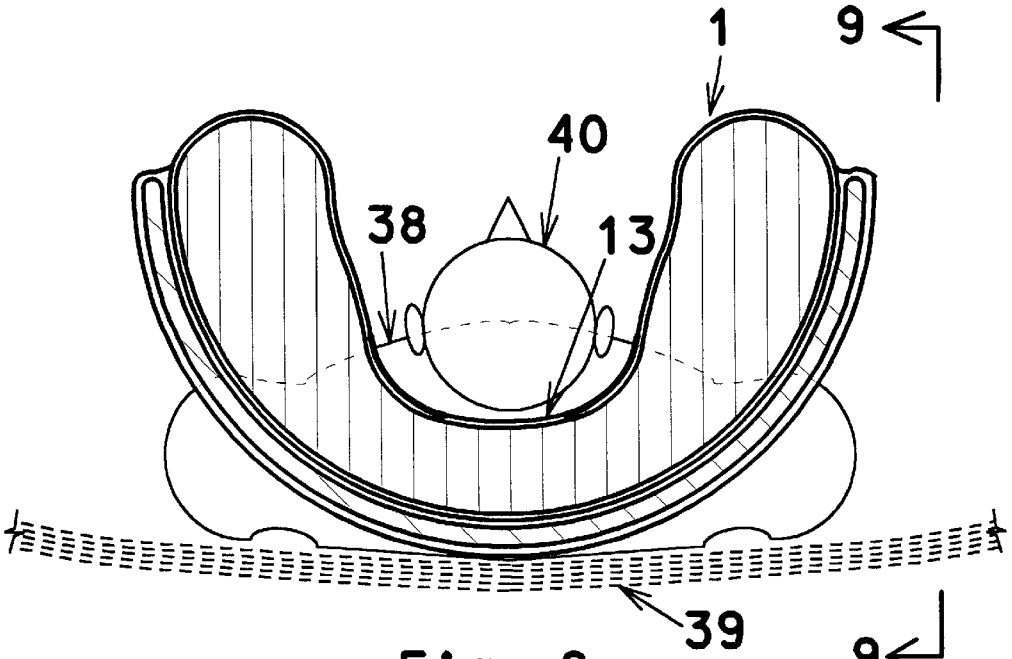
Figure 9:
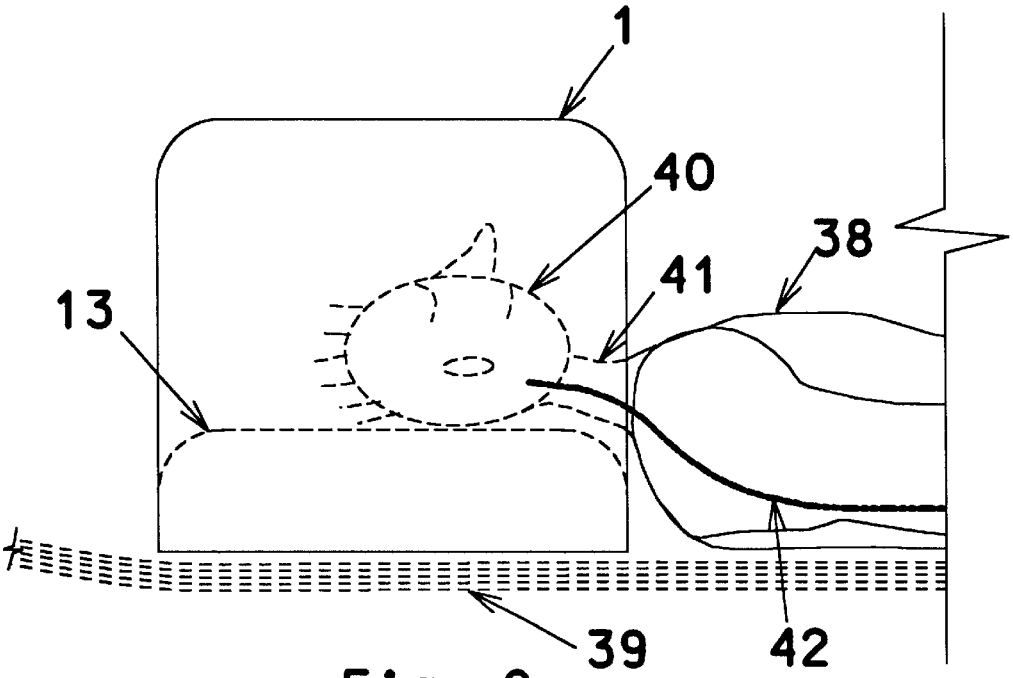
Figure 10:
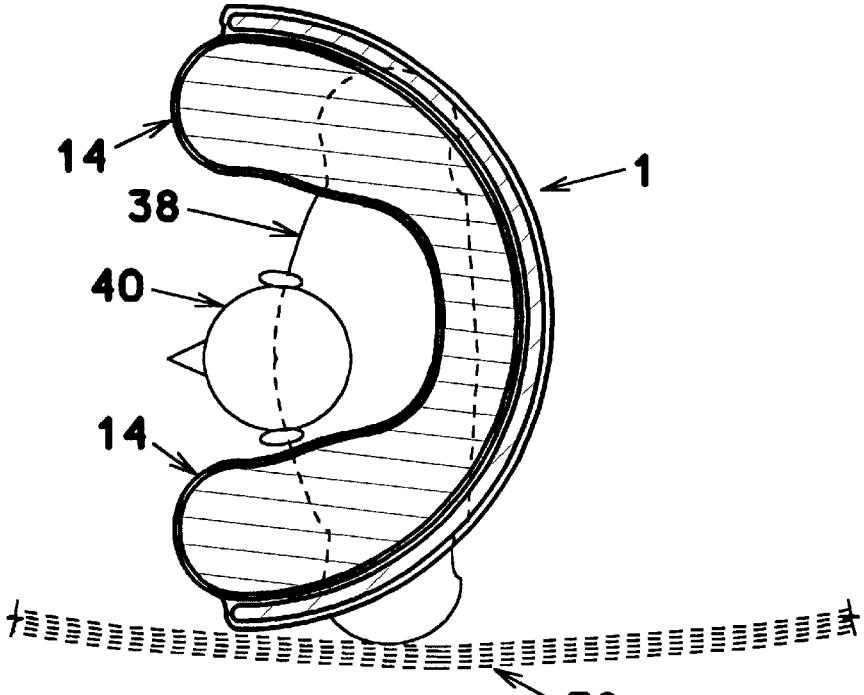

FIG. 8, FIG. 9, FIG. 10 and FIG. 11 illustrate the uses of the first variation of the improved pillow. The user is facing up in FIG. 8 and FIG. 9 while the user is facing sideways in FIG. 10 and FIG. 11. In FIG. 8 and FIG. 10, the sectional views of the improved pillow are shown.

Figure 12:
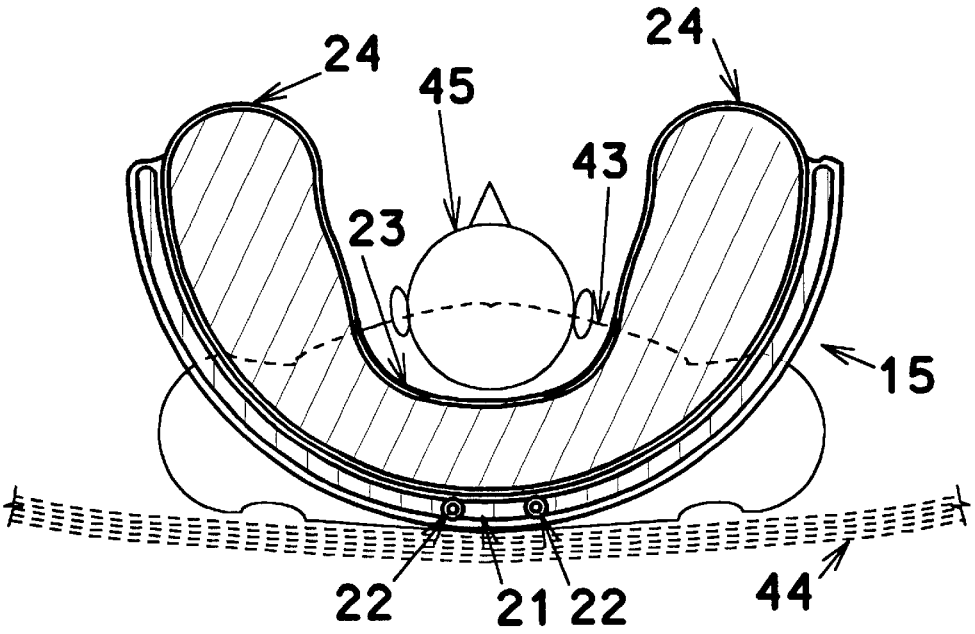
Figure 13:
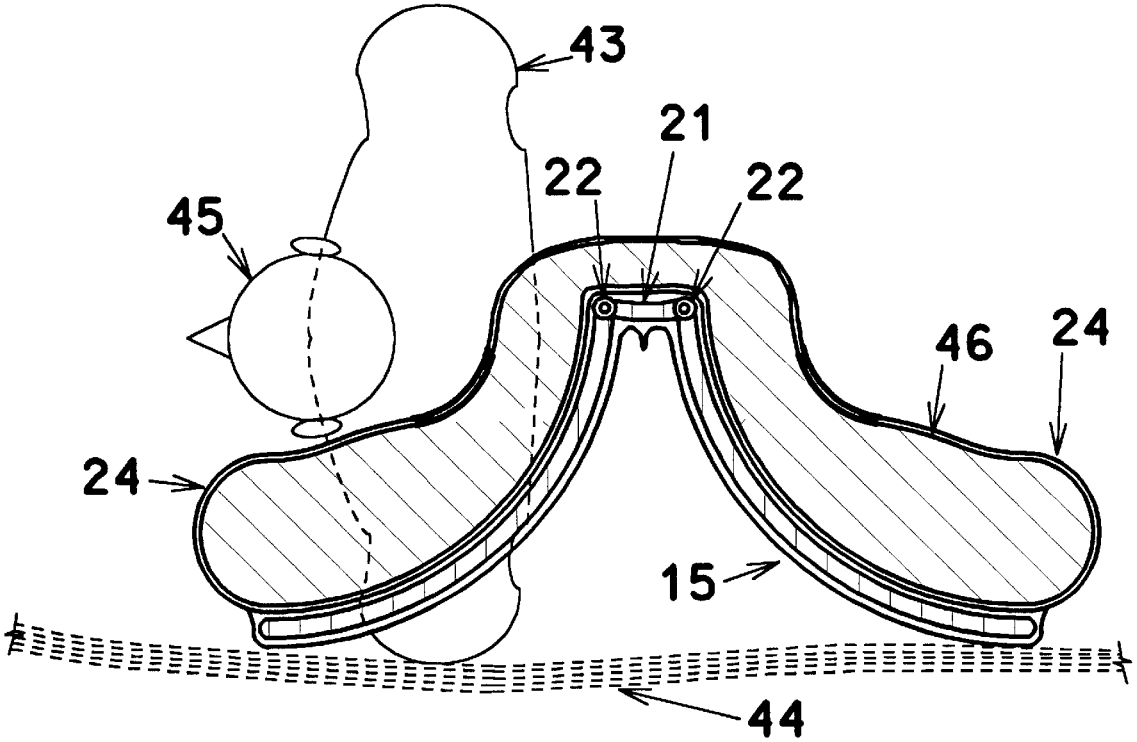

FIG. 12 and FIG. 13 illustrate the uses of the second variation of the improved pillow. The user is facing up in FIG. 12 while the user is facing sideways in FIG. 13. The sectional views of the improved pillow are shown in FIG. 12 and FIG. 13.

Figure 14:
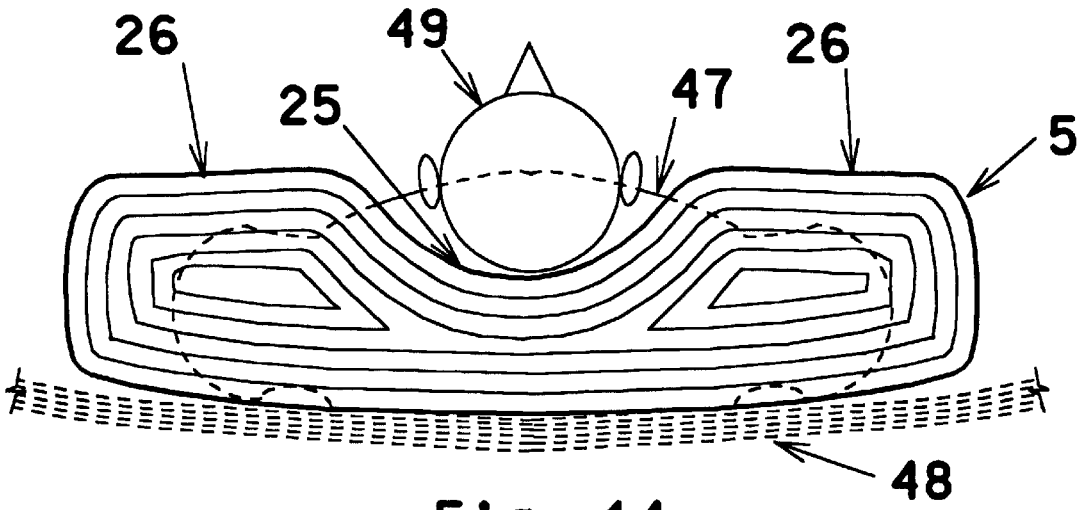
Figure 15:
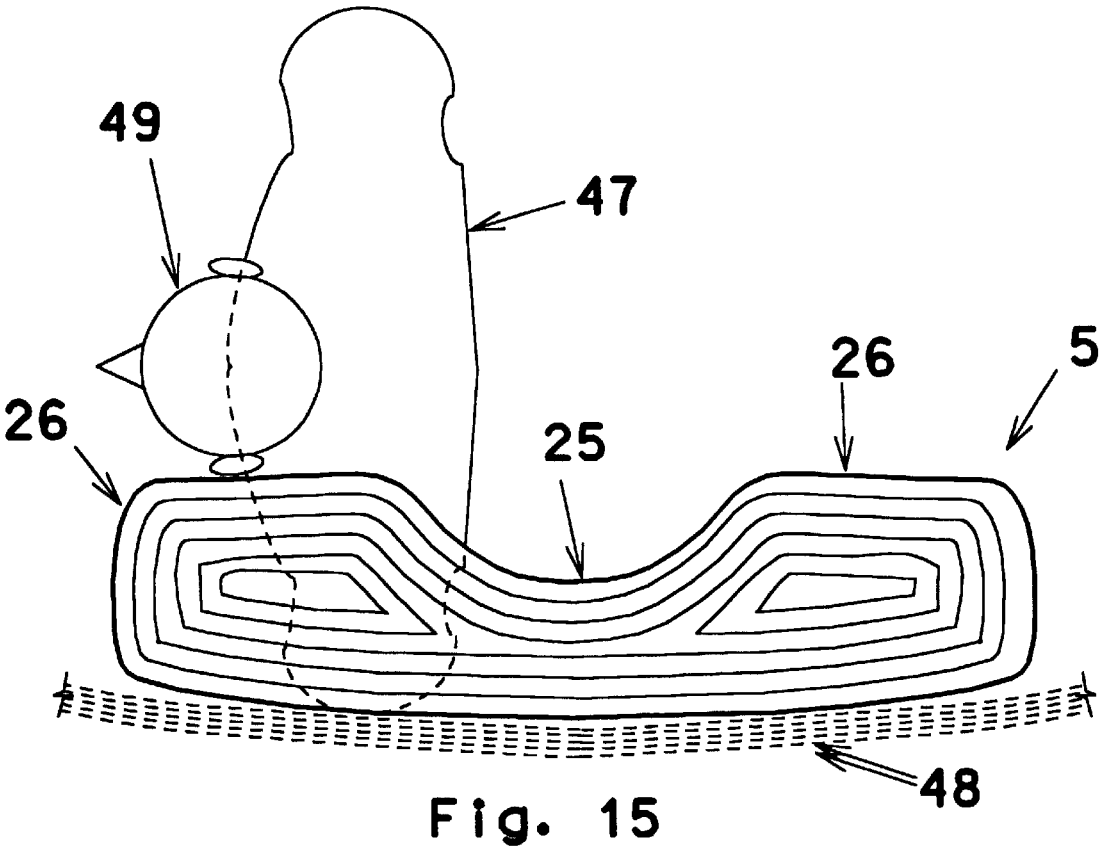

FIG. 14 and FIG. 15 illustrate the uses of the third variation of the improved pillow. The user is facing up in FIG. 14 while the user is facing sideways in FIG. 15.

GENERAL DESCRIPTION

Three variations of the invented improved pillows are introduced herein in this specification.

Figure 1:
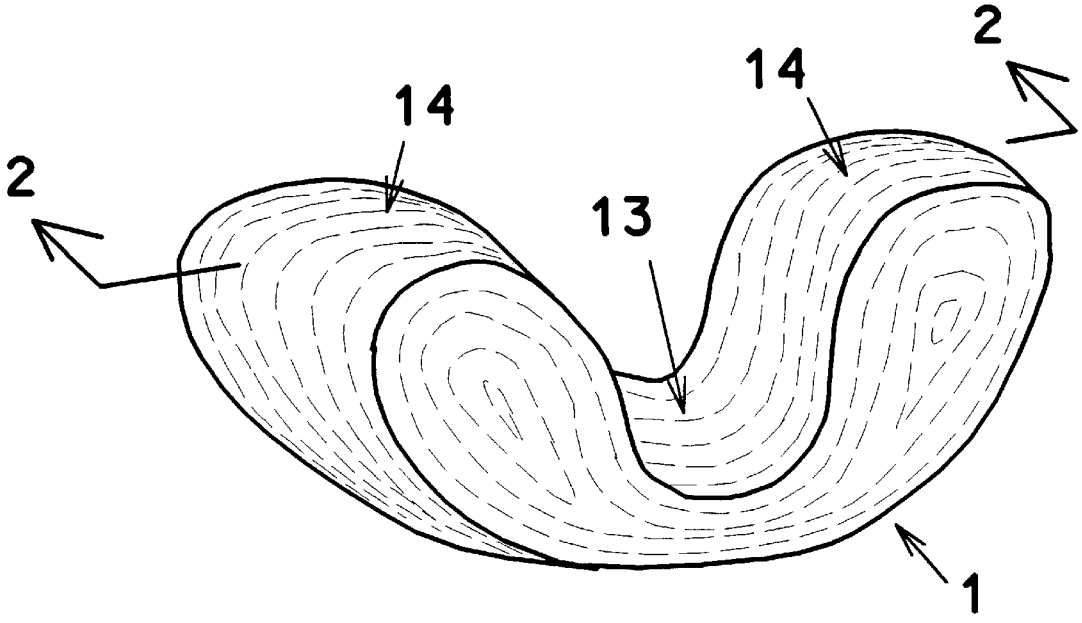
FIG. 1 is an isometric view of the first variation of an invented improved pillow.
Figure 2:
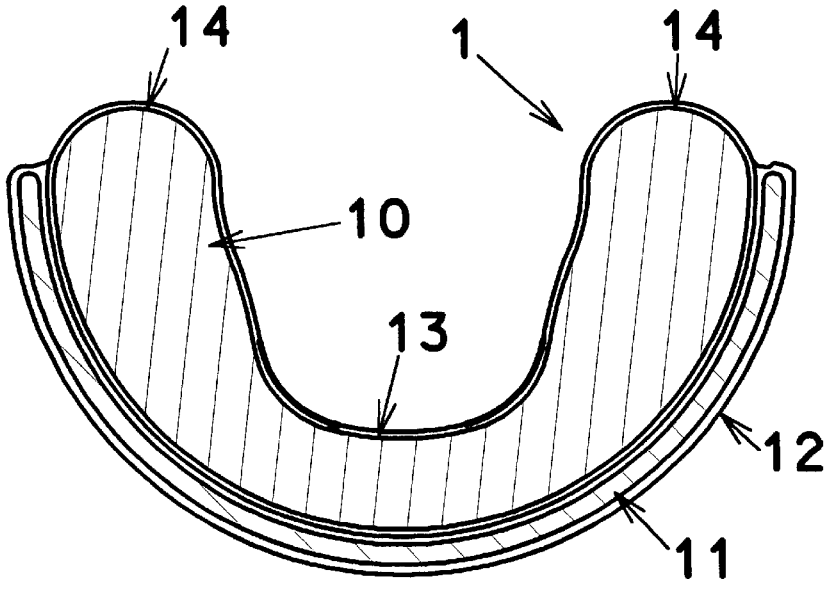
FIG. 2 is a sectional view of the invented device shown in FIG. 1.

Referring to FIGS. 1 and 2, the first variation of an invented improved pillow 1 consists of a cushion 10, a curved plate 11, and a fabric 12. The cushion has thin center portion and two thick edge portions. The cushion is made of any suitable material such as cotton packs, foams, inflatable air bags, feathers, saw dusts, leaves, seeds, etc. The fabric is made of any suitable fabrics such as clothes, silks, leathers, etc. The curved plate is made of any suitable material such as plastics, metals, carbon fibers, glass fibers, etc. The cushion is on the concave side of the curved plate. The fabric encloses the curved plate and the cushion together. The curved plate provides a hard curved surface on the bottom of the improved pillow so that the improved pillow can rock easily on a bed. The curved plate creates the valley 13 and the peaks 14 for the improved pillow. The cushion at the valley of the improved pillow is thinner than that of the peaks.

Figure 3:
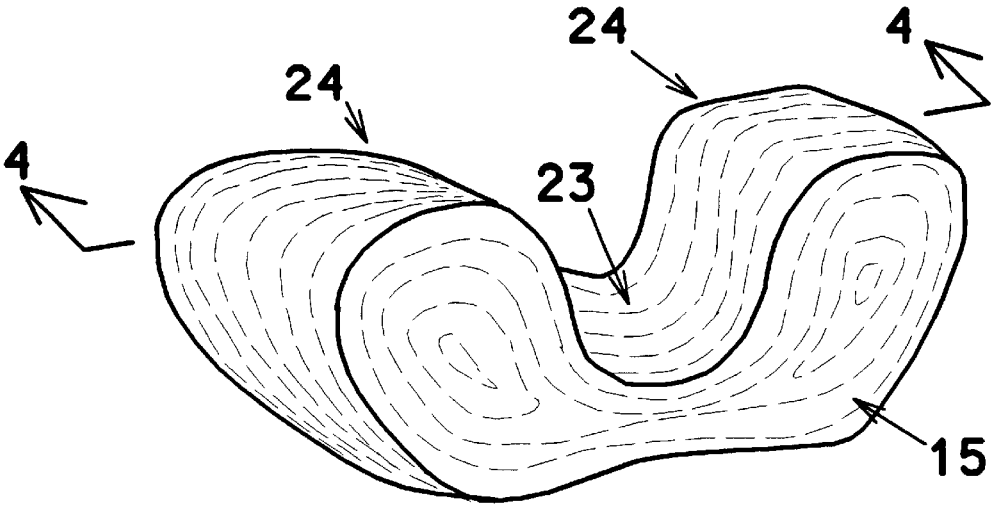
FIG. 3 is an isometric view of the second variation of an invented improved pillow.
Figure 4:
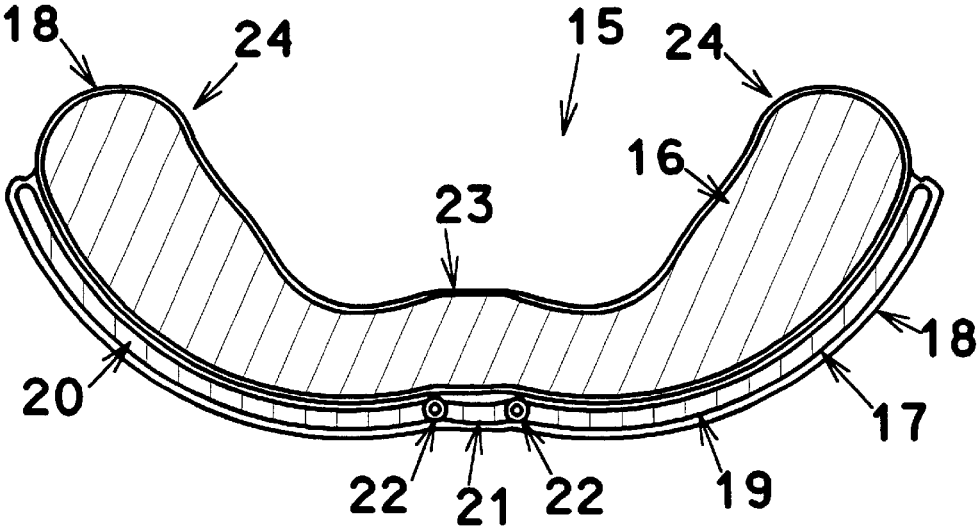
FIG. 4 is a sectional view of the invented device shown in FIG. 3.

Referring to FIGS. 3 and 4, the second variation of an invented improved pillow 15 consists of a cushion 16, a curved plate 17, and a fabric 18. The cushion is made of any suitable material such as cotton packs, foams, inflatable air bags, feathers, saw dusts, leaves, seeds, etc. The fabric is made of any suitable fabrics such as clothes, silks, leathers, etc. The curved plate is made of any suitable material such as plastics, metals, carbon fibers, glass fibers, etc. The curved plate consists of two long curved plates 19 and 20 joined by at least one short curved plate 21 (only one shown in FIG. 4). Hinges 22 or glue-backed fabrics such as duct-tapes (not shown) makes the joining. The cushion is on the concave side of the curved plate. The fabric encloses the curved plate and the cushions together. The curved plate provides a hard curved surface on the bottom of the improved pillow. The curved plate helps to create a valley 23 and two peaks 24 for the improved pillow. The cushion at the valley of the improved pillow is thinner than that of the peaks.

Referring to FIG. 5, the third variation of an invented improved pillow 5 has a saddle-shaped upper portion that has a valley 25 and two peaks 26. The improved pillow is made with a cushion wrapped by a fabric. The cushion is made of any suitable material such as cotton packs, foams, inflatable air bags, feathers, saw dusts, leaves, seeds, etc. The fabric is made of any suitable fabrics such as clothes, silks, leathers, etc.

Referring to FIG. 6, when an ordinary pillow 27 is too thin (low) comparing to half of the width of a sleeper's shoulder 28, the neck 29 of the sleeper lying sideways on a bed 31 bends downwards. This phenomenon is illustrated exaggeratedly with the spine 32 shown in FIG. 6. Therefore, in order to keep a side-lying sleeper's neck straight, a thick (high) pillow must be used. Referring to FIG. 7, when an ordinary pillow 33 is too thick (too high), the neck 34 of the sleeper 35 facing up on a bed 36 bends forwards. The spine 37 shown in FIG. 7 exaggerates the bend.

Referring to FIG. 8 and FIG. 9, when an upwards facing sleeper 38 lying on a bed 39 uses the first variation of an improved pillow 1, the sleeper's head 40 is on the valley 13 of the improved pillow. Because the valley of the improved pillow is relatively thin (low), the sleeper's neck 41 is in its natural position. The sleeper's spine 42 is in correct position.

Figure 11:
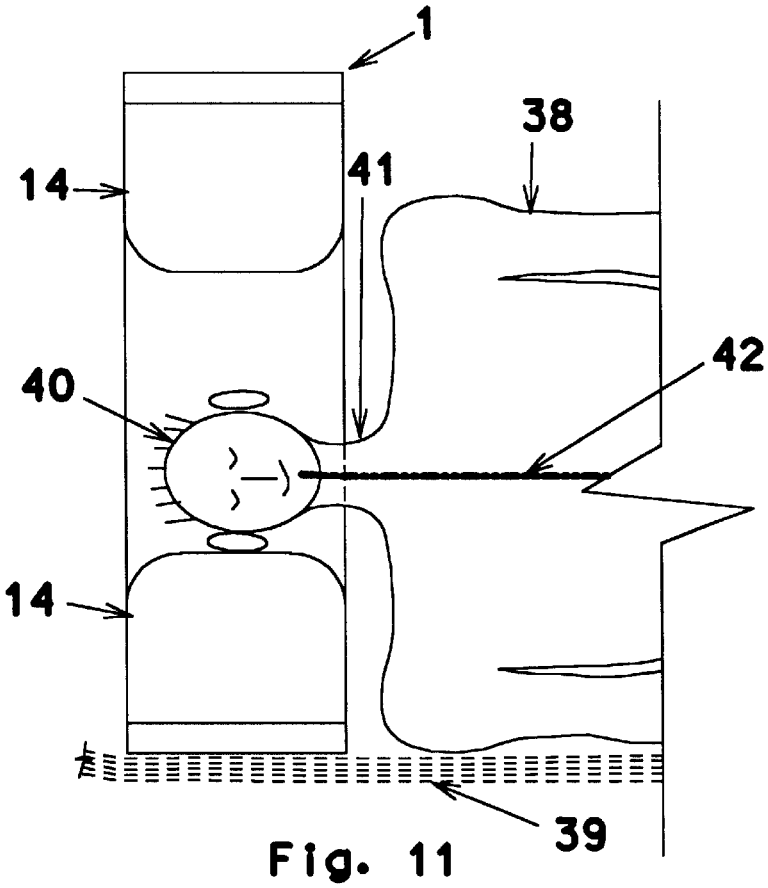

Referring to FIG. 10 and FIG. 11, when a sideways facing sleeper 38 lying on a bed 39 uses the first variation of an improved pillow 1, the sleeper's head is on one of the peak 14 of the improved pillow. Because of the thick (high) cushion at the peaks of the improved pillow, the sleeper's neck 41 does not bend downwards but is in its natural position. The sleeper's spine 42 is in correct position.

The curved hard back of the improved pillow enables the sleeper to roll his/her head easily. When the sleeper rolls on the bed, his/her head rolls. The rolling of his/her head causes the improved pillow to roll. This rolling enables the sleeper's head to change smoothly from the thick (high) peak to the thin (low) valley, or vice versa, of the improved pillow. When the cushions are made of inflatable air bags, their lightweights will make the rolling even easy. When the cushions are made of inflatable air bags, for an example one air bag for the valley portion and one air bag for each of the peak portion, the heights of the cushions can be easily adjusted to the comforts of a sleeper.

Referring to FIG. 12, when a upwards facing sleeper 43 lying on a bed 44 uses the second variation of an improved pillow 15, the sleeper's head 45 is on the valley 23 of the improved pillow. The weight of the head 45 pushes the valley 23 downward and the peaks 24 upwards. As a result, the back of the improved pillow is a curved surface. Because the valley of the improved pillow is relatively thin (low), the sleeper's neck is in its natural position.

Referring to FIG. 13, when a sideways facing sleeper 43 lying on a bed 44 uses the second variation of an invented improved pillow 15, the sleeper's head 45 is on one of the peak 24 of the improved pillow. Due to the weight of the peaks as well as the existence of the short curved plate 21 and the hinges 22, the other peak 46 which the head 45 is not on remains lying on the bed 44. In this way, the rolling of the head 45 will need only to roll half of the weight of the improved pillow. Because of the thick (high) cushion at the peaks of the improved pillow, the sleeper's neck is in its natural position.

Referring to FIG. 14, when a upwards facing sleeper 47 lying on a bed 48 uses the third variation of an improved pillow 5, the sleeper's head 49 is on the valley 25 of the improved pillow. Because the valley of the improved pillow is relatively thin (low), the sleeper's neck will be in its natural position.

Referring to FIG. 15, when a sideways facing sleeper 47 lying on a bed 48 uses the third variation of an improved pillow 5, the sleeper's head 49 is on one of the peaks 26 of the improved pillow. Because of the thick (high) cushion at the peaks of the improved pillow, the sleeper's neck is in its natural position. The major drawback of using this third variation of the improved pillow is that when the sleeper rolls, the sleeper needs to raise or lower his/her head to use either the peak or the valley of the improved pillow.

The foregoing is considered as illustrative only of the principles of the invention. Furthermore, since numerous modifications and changes will readily occur to those skilled in the art, it is not desired to limit the invention to the exact construction and operation shown and described, and accordingly all suitable modifications and equivalents, may be resorted to, falling within the scope of the invention as claimed.

I claim:

1. An improved pillow consists of a) a cushion;

b) a relatively rigid curved plate which consists of at least two curved segment plates pivotably linked together, wherein each curved segment plate consists of a single upwardly facing concave surface;

c) a fabric;

d) said cushion being on the concave side of said curved plate;

e) said fabric enclosing said cushion and said curved plate.

2. The improved pillow of claim 1 wherein said cushion has a thin middle portion and thick end portions.

3. The improved pillow of claim 1 wherein said cushion consists of at least one inflatable air bag.

* * * * *